US005280688A

United States Patent [19]

Zoccoli

[11] Patent Number: 5,280,688

[45] Date of Patent: Jan. 25, 1994

[54] RECYCLING APPARATUS

[76] Inventor: Richard S. Zoccoli, 77 Bemis St., Terryville, Conn. 06786

[21] Appl. No.: 835,520

[22] Filed: Feb. 14, 1992

[51] Int. Cl.[5] ..... E04H 14/00

[52] U.S. Cl. ..... 52/173.1; 232/43.1; 232/43.2; 209/702; 220/477

[58] Field of Search ..... 58/173 R, 192; 232/43.1, 43.2, 43.3; 209/702, 930, 942; 220/908, 909, 477; 280/47.26, 47.24

[56] References Cited

U.S. PATENT DOCUMENTS

| | | | |
|---|---|---|---|
| 3,261,441 | 7/1966 | Mullens | 232/43.2 |
| 3,510,055 | 5/1970 | Safford | 232/43.2 |
| 3,554,345 | 1/1971 | Mullens | 232/43.2 |
| 4,013,215 | 3/1977 | Mercier | 232/43.1 |
| 4,032,037 | 6/1977 | Dubery | 220/908 X |
| 4,893,722 | 1/1990 | Jones | 220/503 |
| 4,930,653 | 6/1990 | Machado | 220/908 X |
| 5,014,858 | 5/1991 | Armstrong | 209/930 X |
| 5,040,808 | 8/1991 | McIntyre | 380/47.26 X |
| 5,083,704 | 1/1992 | Rounthwaite | 209/702 X |
| 5,090,785 | 2/1992 | Stamp | 220/908 X |

*Primary Examiner*—Carl D. Friedman
*Assistant Examiner*—Beth A. Aubrey
*Attorney, Agent, or Firm*—Leon Gilden

[57] ABSTRACT

A self-contained chute includes a hood directed through a dwelling wall, with the hood including a first and second respective conduit aligned with a direction chute formed with a chute first and second conduit, with the direction chute fixedly mounted to the dwelling wall exterior surface terminating in a chute lower distal end spaced above a chute housing floor. The chute housing floor includes respective first and second doors receiving a vehicular cart for support of a respective first and second receptacle. The respective first and second receptacle is aligned with the respective first and second chute conduit permitting removal of the first and second receptacle by use of the vehicular cart for storage space within the associated dwelling.

2 Claims, 4 Drawing Sheets

RECYCLING APPARATUS

BACKGROUND OF THE INVENTION

1. Field of the Invention

The field of invention relates to recycling apparatus, and more particularly pertains to a new and improved recycling apparatus wherein the same is arranged for eliminating recycling storage within a dwelling.

2. Description of the Prior Art

Storage of various components by individuals requires the provision of a predetermined area for storage of such components. In an effort to minimize and eliminate the duplication of such storage within a dwelling, the instant invention attempts to overcome deficiencies of the prior art by providing a chute structure directed exteriorly of the associated dwelling in cooperation with removal apparatus with a transportable cart structure. While various chute structure is available in the prior art, such as exemplified in U.S. Pat. No. 4,772,380 to Cramer, the chute structure is oriented towards the directional movement of material therethrough.

U.S. Pat. No. 4,893,722 to Jones sets forth a compartmented waste receptacle for segregating various recycling components such as glass and the like.

As such, it may be appreciated that there continues to be a need for a new and improved recycling apparatus as set forth by the instant invention which addresses both the problems of ease of use as well as effectiveness in construction in the directional removal of recycling components and their segregation relative to a dwelling and in this respect, the present invention substantially fulfills this need.

SUMMARY OF THE INVENTION

In view of the foregoing disadvantages inherent in the known types of recycling apparatus now present in the prior art, the present invention provides a recycling apparatus wherein the same utilizes chute structure mounted through and secured along a dwelling wall for removal of recycling components relative to a dwelling interior surface. As such, the general purpose of the present invention, which will be described subsequently in greater detail, is to provide a new and improved recycling apparatus which has all the advantages of the prior art recycling apparatus and none of the disadvantages.

To attain this, the present invention provides a self-contained chute including a hood directed through a dwelling wall, with the hood including a first and second respective conduit aligned with a direction chute formed with a chute first and second conduit, with the direction chute fixedly mounted to the dwelling wall exterior surface terminating in a chute lower distal end spaced above a chute housing floor. The chute housing floor includes respective first and second doors receiving a vehicular cart for support of a respective first and second receptacle. The respective first and second receptacle is aligned with the respective first and second chute conduit permitting removal of the first and second receptacle by use of the vehicular cart for storage space within the associated dwelling.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved recycling apparatus which has all the advantages of the prior art recycling apparatus and none of the disadvantages.

It is another object of the present invention to provide a new and improved recycling apparatus which may be easily and efficiently manufactured and marketed.

It is a further object of the present invention to provide a new and improved recycling apparatus which is of a durable and reliable construction.

An even further object of the present invention is to provide a new and improved recycling apparatus which is susceptible of a low cost of manufacture with regard to both materials and labor, and which accordingly is then susceptible of low prices of sale to the consuming public, thereby making such recycling apparatus economically available to the buying public.

Still yet another object of the present invention is to provide a new and improved recycling apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
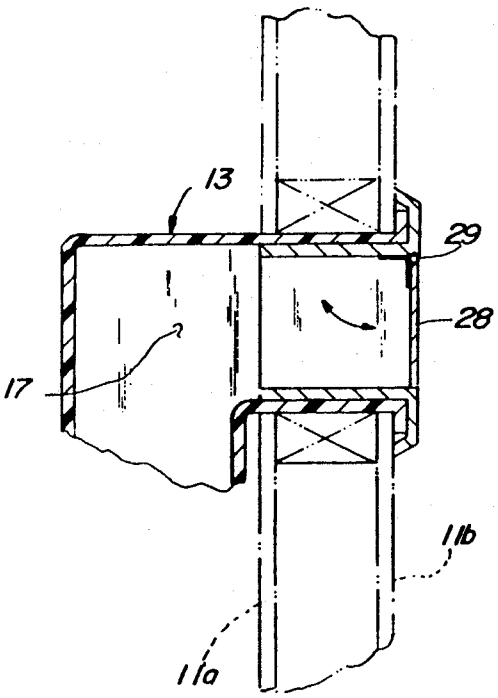
FIG. 2 is an orthographic view, taken along the lines 2—2 of FIG. 1 in the direction indicated by the arrows.
Figure 1:
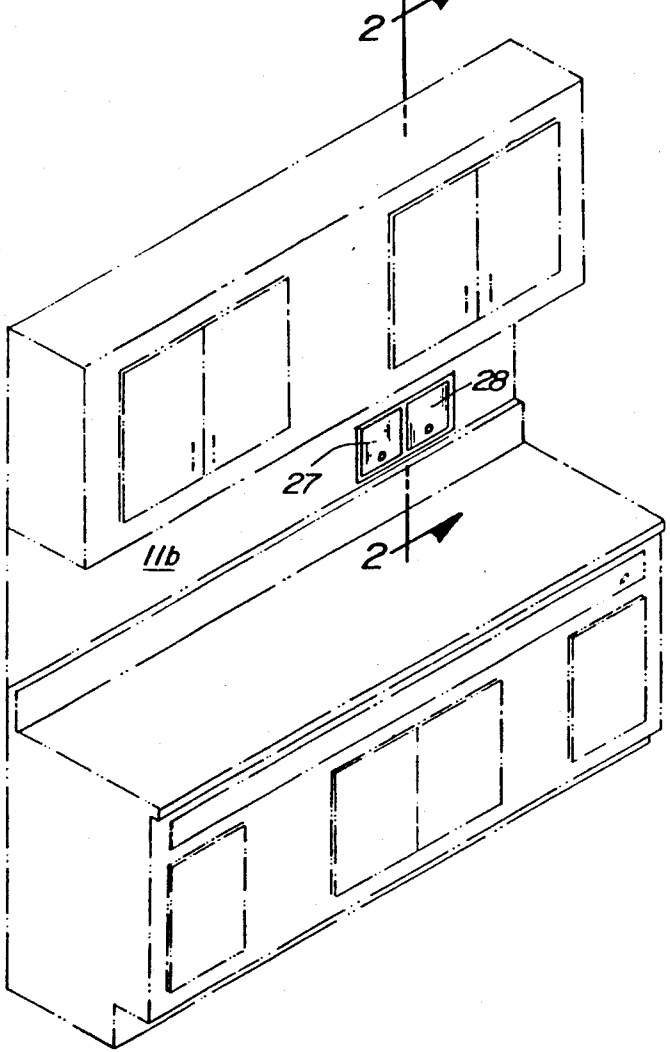
FIG. 1 is an isometric illustration of an interior surface of the dwelling wall.
Figure 3:
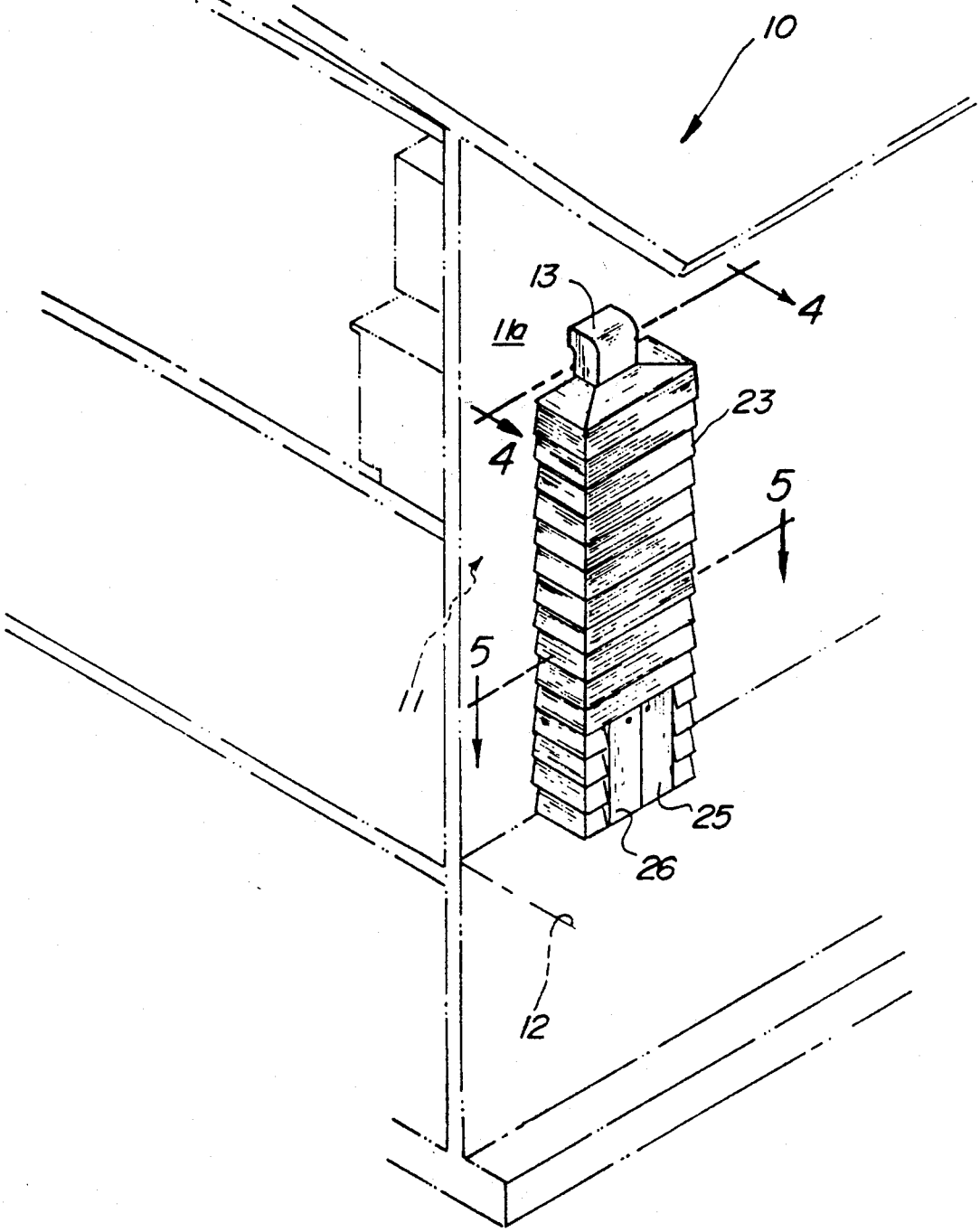
FIG. 3 is an isometric illustration of the invention mounted to an associated dwelling wall.
Figure 4:
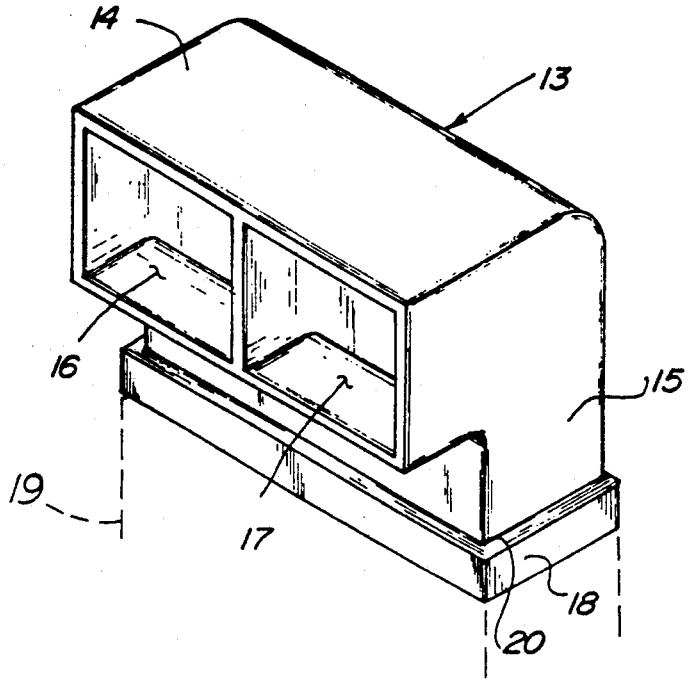
FIG. 4 is an isometric illustration of the hood structure utilized by the invention.
Figure 6:
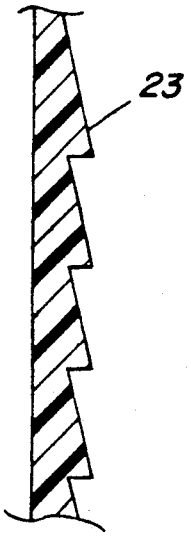
FIG. 6 is an exterior surface of the chute housing.
Figure 5:
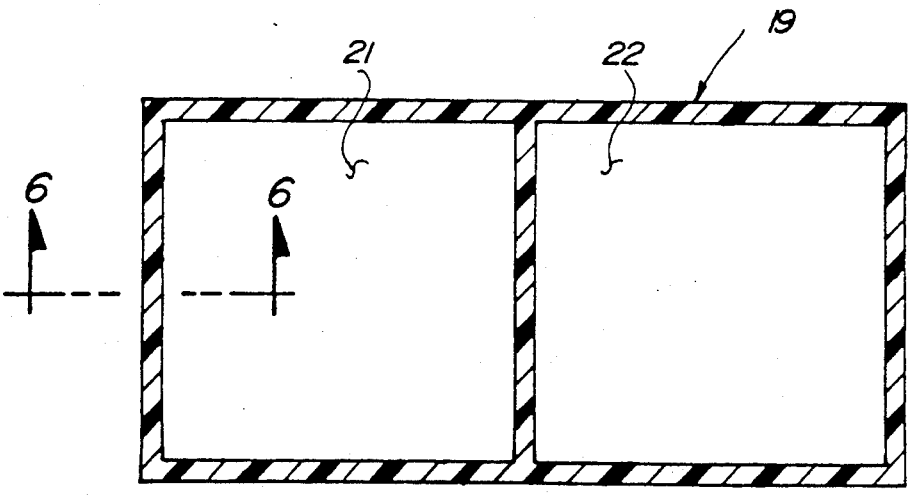
FIG. 5 is an orthographic view, taken along the lines 5—5 of FIG. 3 in the direction indicated by the arrows.
Figure 7:
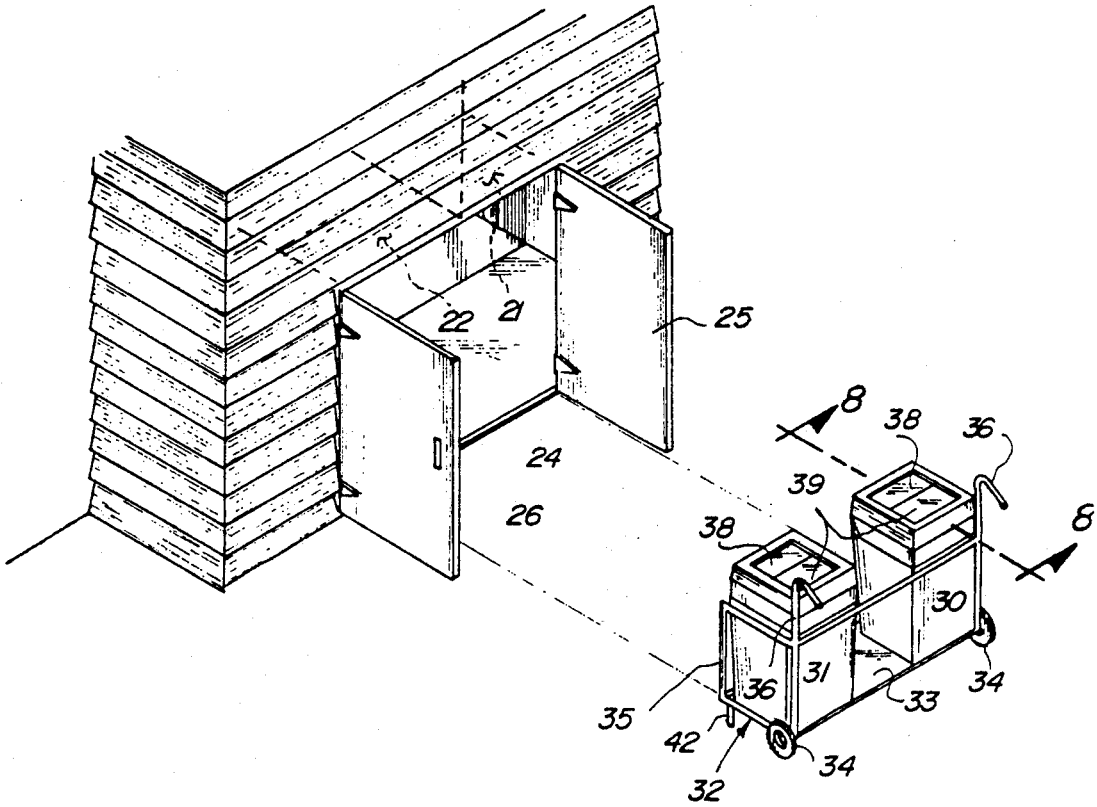
FIG. 7 is an isometric illustration of the lower end of the housing.
Figure 8:
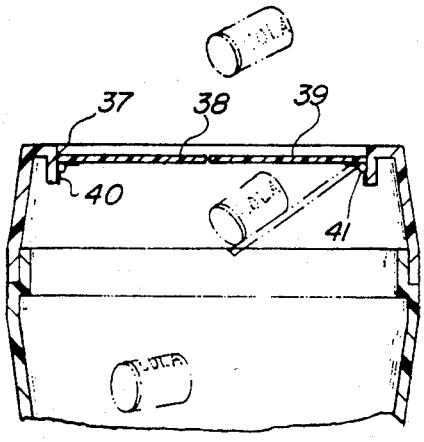
FIG. 8 an orthographic view, taken along the lines 8—8 of FIG. 7 in the direction indicated by the arrows.

With reference now to the drawings, and in particular to FIGS. 1 to 8 thereof, a new and improved recycling apparatus embodying the principles and concepts of the present invention and generally designated by the reference numeral 10 will be described.

More specifically, the recycling apparatus 10 of the instant invention essentially comprises the organization mounted within a dwelling to include a dwelling wall 11. The dwelling wall 11 includes a dwelling wall outer surface 11*a* spaced from a dwelling wall inner surface 11*b*. The apparatus extends exteriorly of the dwelling wall, as illustrated in the FIG. 3, for mounting to a ground surface 12 by a chute housing 23.

A directional hood 13 is directed and secured through the dwelling wall 11, with the hood including a hood first tube 14 orthogonally oriented relative to a hood second tube 15. The first and second tubes 14 and 15 are in communication with one another and are divided into adjacent and coextensive hood first and second conduits 16 and 17 directed coextensively through the first and second tubes 14 and 15 from an upper distal end of the hood 13 to a lower distal end of the hood 13. A hood lower distal end skirt 18 is arranged in surrounding relationship relative to a hood abutment flange 20 that is orthogonally projecting exteriorly of the hood lower distal end. The abutment flange 20 receives an upper distal end of a directional chute 19. The directional chute 19 includes a chute first conduit 21 and a chute second conduit 22 that are aligned respectively relative to the hood first and second conduits 16 and 17. The chute housing 23 is arranged in surrounding relationship relative to the directional chute for affording protection to the chute structure relative to environmental and human circumstances. The chute housing 23 includes a housing floor 24 oriented below the lower distal end of the directional chute 19 directed through the chute housing 23. A respective housing first door and a housing second door are orthogonally oriented relative to the chute lower distal end, and more specifically to the respective chute first conduit 21 and the chute second conduit 22 extending between the first conduit 21 and the second conduit 22 and the housing floor 24. The housing first door 25 and the housing second door 26, as noted above, are arranged to provide for an enclosure within the housing 23 below the respective chute first and second conduits 21 and 22. It should be noted the direction hood 13, such as illustrated in the FIGS. 1 and 2, includes a respective hood first conduit door 27 and a hood second conduit door 28 hingedly mounted to an entrance of the respective hood first conduit 16 and the hood second conduit 17. Each hood conduit door 27 and 28 includes a spring hinge 29 to maintain the respective first and second conduit doors 27 and 28 in a first position orthogonally oriented relative to the respective hood first and second conduits 16 and 17.

Positioned below the respective chute first conduit 21 and the chute second conduit 22 is a respective first receptacle 30 and a second receptacle 31 mounted to a receptacle cart 32. The receptacle cart 32 includes a cart floor 33 formed with wheels 34 projecting exteriorly of each end of the cart, with a cart floor support rod 42 orthogonally directed downwardly relative to the cart floor, with a single cart floor support rod 42 oriented forwardly of each respective wheel 34. A framework 35 is arranged in surrounding relationship relative to the receptacles, and with the framework including a plurality of framework handles 36 extending rearwardly of the framework and of the floor for ease of manipulation of the cart and the associated receptacles positioned thereon.

Each of the respective first and second receptacles 30 and 31 includes a receptacle entrance 37 formed with an entrance first door and entrance second door 38 and 39 respectively hingedly mounted about a respective first door spring hinge 40 and second door spring hinge 41 that are mounted to opposed ends of each entrance 38. In this manner, recycling components directed through the respective first and second chutes are directed through the entrance first and second doors 38 and 39, wherein the spring hinges 40 and 41 maintain the entrance doors in a further first position that are coplanar relative to one another to a second position, wherein the entrance doors are oriented in an oblique orientation relative to one another, in a manner as illustrated in phantom in FIG. 8.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A recycling apparatus, comprising in combination, a directional hood, the directional hood fixedly secured through a dwelling wall, with the dwelling wall including a wall outer surface and a wall inner surface, the directional hood including a hood first end projecting through the wall inner surface and a hood second end oriented exteriorly of the wall outer surface, and the hood including a hood first tube obliquely oriented relative to a hood second tube, and the hood first tube and the hood second tube include a respective hood first conduit and a hood second conduit, wherein the hood first conduit and the hood second conduit extend from the hood first end to the hood second end and are in a coextensive adjacent relationship relative to one another, and the directional hood includes a direction chute mounted to the hood second end, wherein the directional chute extends in adjacency relative to the wall outer surface, and a chute housing arranged in surrounding relationship relative to the directional chute, and the chute housing including a housing floor oriented below the directional chute lower end, and the chute housing including a housing first door positioned between the chute first conduit and the housing floor, and a housing second door oriented between the chute second conduit and the housing floor, and a first receptacle positioned below the chute first conduit and oriented above the housing floor, and a second receptacle positioned below the chute second conduit and oriented above the housing floor, and the first receptacle and the second receptacle are mounted within a receptacle cart, the receptacle cart including a cart floor, the cart floor mounting the first receptacle and the second receptacle thereon, and the cart floor including a cart floor plurality of wheels, the wheels extending exteriorly of the cart floor and rotatably mounted thereto, and each wheel is positioned rearwardly of a cart floor support rod, each cart floor support rod integrally mounted to the cart floor and forwardly of a respective wheel, and the cart floor includes a framework extending upwardly of the cart floor, wherein the framework is arranged in surrounding relationship relative to the first receptacle and the second receptacle, and the framework including a plurality of framework handles extending rearwardly of the framework for manual grasping of the handles for manipulation of the cart, and the directional hood first end including a first conduit door oriented adjacent the hood first conduit, and a hood second conduit door positioned adjacent the hood second conduit, each hood first and second conduit door including a hood spring hinge to maintain the hood first conduit and the hood second conduit door in an orthogonal relationship relative to the hood first conduit and the hood second conduit respectively, and the first receptacle and the second receptacle includes a respective receptacle entrance, and each receptacle entrance includes an entrance first door and entrance second door, the entrance first door and entrance second door arranged in a coplanar relationship relative to one another in a first position, and the entrance first door and the entrance second door include respective first door spring hinge and a second door spring hinge to maintain the entrance first door and the entrance second door in the coplanar relationship.

2. An apparatus as set forth in claim 1 wherein the directional chute includes a chute upper distal end, and the chute upper distal end is received within the hood second end, the hood second end includes an abutment flange orthogonally oriented to the hood second end extending exteriorly thereof, and a hood skirt extending downwardly relative to the abutment flange in surrounding relationship to receive the directional chute upper end within the skirt.

* * * * *